United States Patent [19]

Elwing et al.

[11] 4,253,270

[45] Mar. 3, 1981

[54] INVISIBLE MARIONETTE

[76] Inventors: Carl E. Elwing; Mary J. Elwing, both of 4032 Saginaw Trail, Drayton Plains, Mich. 48020

[21] Appl. No.: 40,415

[22] Filed: May 18, 1979

[51] Int. Cl.[3] ..... G09F 11/00

[52] U.S. Cl. ..... 46/126

[58] Field of Search ..... 46/120, 121, 123, 124, 46/126; 40/420, 418

[56] References Cited

U.S. PATENT DOCUMENTS

| | | | |
|---|---|---|---|
| 2,662,338 | 12/1953 | Baird | 46/126 |
| 2,747,329 | 5/1956 | Gruenewaelder | 46/126 |
| 2,932,919 | 4/1960 | Evans | 40/418 |
| 4,123,865 | 11/1978 | Pearson | 46/126 |

*Primary Examiner*—Robert A. Hafer

*Attorney, Agent, or Firm*—Basile, Weintraub & Hanlon

[57] ABSTRACT

An invisible marionette comprising a pair of feet is disclosed. A hand operated manipulator including control lines which extend from the manipulator to the feet provides animation. The manipulator comprises a longitudinal member with front and rear cross members affixed thereto. The control lines extend from an extremity of the cross members to the feet.

3 Claims, 2 Drawing Figures

INVISIBLE MARIONETTE

BACKGROUND OF THE INVENTION

I. Field of the Invention

The present invention relates to the field of animated figures. More particularly the present invention relates to the field of animated marionettes. Even more particularly the present invention relates to the field of animated portions of marionettes.

II. Prior Art Statement

Marionettes manipulated by strings or control lines have long been known. U.S. Pat. No. 1,987,528 discloses a figure toy comprising an egg shaped head and movable arms which are manipulated by control lines. U.S. Pat. No. 2,657,499 discloses a marionette construction which includes articulated feet hinged to an end of a leg member. The marionette is articulated by control lines which extend to a hand operated manipulator. No control lines extend to the feet in this disclosure. U.S. Pat. No. 4,123,865 discloses an animated show-window for articles of clothing. The articles of clothing are animated by control lines which extend to various articles of clothing arranged within the window. A pair of control lines extend to the toe portion of a pair of shoes to move the toes of the shoes up and down in a animated manner. The shoes do not move along the floor of the window. The toes of the shoes move alternately up and down with the heel of the shoe never leaving the floor.

The above listed U.S. patents constitute the closest prior art known to the applicant and his attorney.

SUMMARY OF THE INVENTION

The invisible marionette of the present invention comprises a pair of feet animated by a hand operated manipulator. The manipulator comprises a longitudinal member with a front cross member affixed thereto and a rear cross member affixed to the longitudinal member spaced a distance from the front cross member.

Control lines are affixed to the extremities of the cross members, the control lines extending downward to where they are attached to the front and rear portions of the feet. A first pair of control lines extend from a left extremity of the front cross member to the sides of a front portion of the left foot. A second control line extends from a left extremity of the rear cross member to a center of the heel of the left foot. Raising the left extremity of the front cross member raises the toe of the left foot, and raising the left extremity of the rear cross member raises the heel of the left foot. Raising the left extremity of both the front and rear cross member raises the foot above the floor. A third pair of control lines extends from the right extremity of the front cross member to the sides of a front portion of the right foot, and a fourth control line extends from a right extremity of the rear cross member to a center of the heel of the right foot. Raising the right extremity of the front cross member raises the toe of the right foot, and raising the right extremity of the rear cross member raises the heel of the right foot, while raising both right extremities of the front and rear cross members raises the right foot above the floor.

It is readily apparent to the skilled artisan in the field of animated marionettes that employing the pair of feet and the hand operated manipulator as described hereinabove enables the skilled operator to simulate walking, dancing, or any of a multitude of activities for the feet.

For a more complete understanding of the present invention reference is made to the following detailed description and accompanying drawing.

Other objects, advantages, and applications of the present invention will become apparent to those skilled in the field to which this invention pertains, when the accompanying description of the best modes contemplated for practicing the invention are read in conjunction with the accompanying drawing.

BRIEF DESCRIPTION OF THE DRAWING

In the drawing like reference numbers refer to like parts throughout the several view, and wherein.

DESCRIPTION OF THE PREFERRED EMBODIMENT

Figure 1:
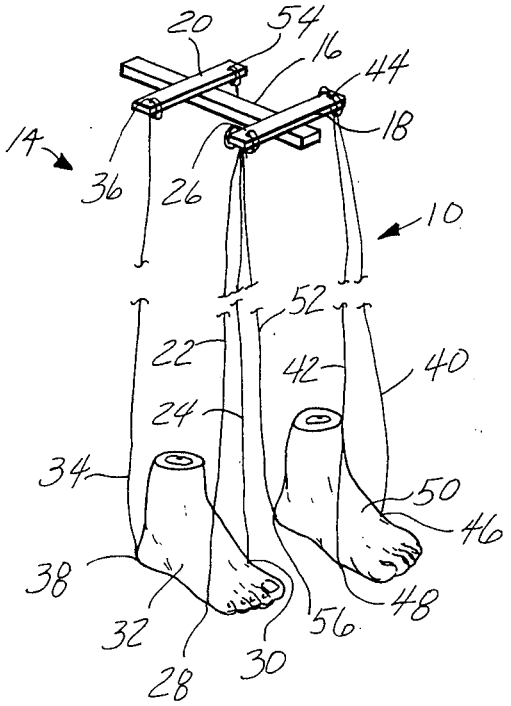
FIG. 1 illustrates a preferred embodiment of the feet and manipulator of the present invention.

Referring, now, to the drawing and in particular to FIG. 1 wherein there is illustrated at 10 a preferred embodiment of the present invention. The invisible marionette of the present invention comprises a pair of feet 12 which are animated by a hand operated manipulator 14.

The manipulator 14 comprises a longitudinal member 16 having a front cross member 18 fixedly attached thereto by screws, nails, adhesive, or the like.

A first pair of control lines 22,24 extend from a left extremity of the front cross member 18 to the sides 28, 30 of the left foot 32. Raising the left extremity 26 of the front cross member 18 raises the toe of the left foot from the floor. By employing a pair of control lines 22,24 which extend from the left extremity 26 of the front cross member 18 to the sides 28,30 of the left foot 32, the foot 32 does not rotate as it is raised above the floor. If a single control line were employed it would have to be carefully attached to a line extending through the center gravity of the foot 32 to prevent rotation of the foot as it is raised. The employment of a pair of lines 22,24 makes manipulation of the foot 32 considerably easier. A second control line 34 extends from the left extremity 36 of the rear cross member 20 to a heel portion of the left foot 32.

Raising the left portion of the rear cross member 20 raises the heel 38 of the left foot 32, and raising the left portion 26 of the forward cross member 18 and the left portion of the rear cross member 20 simultaneously raises the foot 32 above the floor.

A third pair of control lines 40,42 extend from a right extremity 44 of the front cross member 18 to the sides 46,48 of a front portion of a right foot 50. A fourth control line 52 extends from a right extremity 54 of the rear cross member 20 to a center 56 of the heel of the right foot 50. Raising the right extremity of the front cross member 18 raises the toe of the right foot 50 above the floor. Raising the right extremity of the rear cross member 20 raises the heel of the right foot above the floor, and raising the right extremity 44 of the front cross member 18 and the right extremity 54 of the rear cross member 20 simultaneously raises the right foot 50 above the floor. By employing a pair of control lines 40,42 extending from the right extremity of the forward cross member 18 to the sides of the right foot 50, rotation of the foot is prevented as the toe of the foot is raised.

Figure 2:
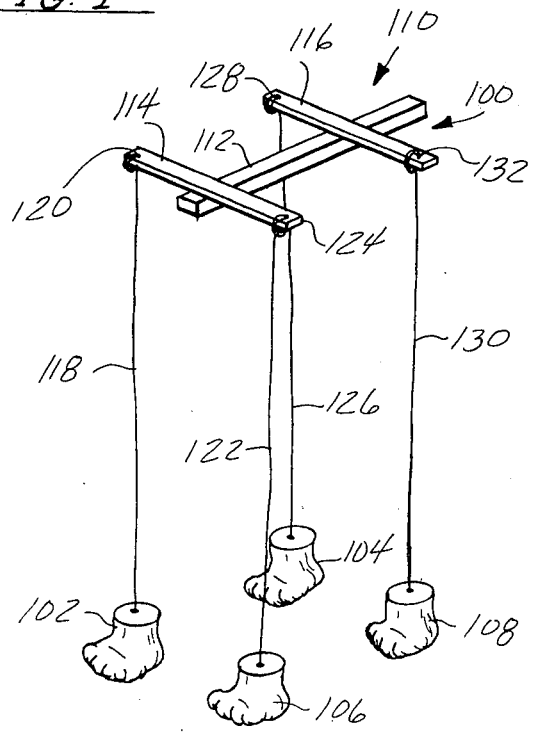
FIG. 2 illustrates an embodiment of the present invention simulating the feet of a four footed animal.

Referring again to the drawing and in particular to FIG. 2 wherein there is illustrated at 100 another embodiment of the invisible marionette wherein the animation of the feet of a four footed animal is illustrated. The invisible marionette of a four footed animal comprises four weighted fur covered paws 102,104,106 and 108 which depict the four paws of an animal such as a dog. The four paws are animated by a manipulator 110 which comprises a longitudinal member 112, a front cross member 114, and a rear cross member 16 spaced from the front cross member 114. The cross members 114 and 116 are affixed to the longitudinal member 112 by the employment of screws, nails, adhesives, or the like. A control line 118 extends from a right extremity 120 of the front cross member 114 to the right front paw 102. Raising the right extremity of the front cross member 114 raises the right front paw 102 from the floor. A second control line 122 extends from a left extremity 124 of the front cross member 114 to the left front paw 106.

A rear right control line 126 extends from a right extremity 128 of the rear cross member 116 to the right rear paw 104, and raising the right extremity of the rear cross member 126 raises the right rear paw 104.

A left rear control line 130 extends from a left extremity 132 of the rear cross member 116 to the left rear paw 108. Raising the left extremity 132 of the rear cross member 116 raises the left rear paw 108.

The feet alternately can be replaced by shoes with the control lines affixed to the shoes in the manner described hereinabove. Different types of shoes can be employed with distinguishing characteristics including male, female, and shoes for various athletic activities.

There has been described hereinabove an invisible marionette wherein the feet only of an animal or person to be animated are used. It is obvious to the skilled artisan that using the manipulators and the feet or paws as described hereinabove, many hours of humorous entertainment can be produced for children and adults alike.

Having thus described our invention what we claim is:

1. An invisible marionette comprising:

a pair of feet;

a hand operated manipulator, said manipulator comprising:

a longitudinal member; a front cross member affixed to the longitudinal member; a rear cross member affixed to the longitudinal member spaced from the front cross member;

a first pair of control lines extending from a left extremity of the front cross member to the sides of a front portion of the left foot;

a second control line extending from a left extremity of the rear cross member to a center of the heel of the left foot;

a third pair of control lines extending from a right extremity of the front cross member to the sides of a front cross member to the sides of a front portion of the right foot; and a fourth control line extending from a right extremity of the rear cross member to a center of the heel of the right foot.

2. The invisible marionette of claim 3 further comprising a pair of shoes covering or replacing the feet.

3. The invisible marionette of claim 2 wherein the shoes have a distinguishing characteristic including male, female, and athletic shoes.

* * * * *

UNITED STATES PATENT AND TRADEMARK OFFICE

CERTIFICATE OF CORRECTION

PATENT NO. : 4,253,270

DATED : March 3, 1981

INVENTOR(S) : Carl E. Elwing and Mary J. Elwing

It is certified that error appears in the above-identified patent and that said Letters Patent are hereby corrected as shown below:

The descriptive Figure and Figure 1 should appear as shown below:

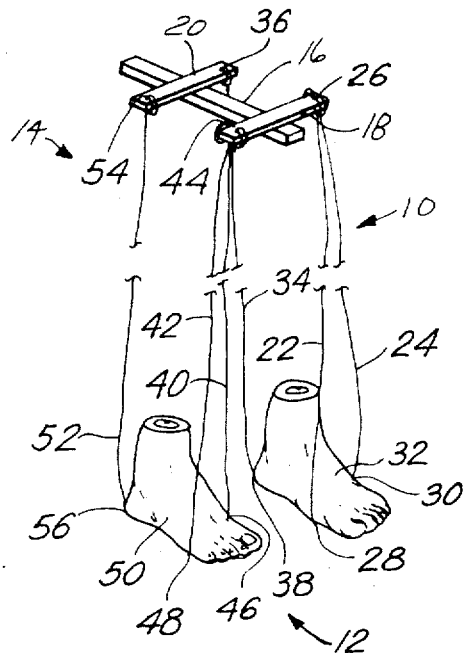

UNITED STATES PATENT AND TRADEMARK OFFICE

CERTIFICATE OF CORRECTION

PATENT NO. : 4,253,270

DATED : March 3, 1981

INVENTOR(S) : Carl E. Elwing and Mary J. Elwing

It is certified that error appears in the above-identified patent and that said Letters Patent are hereby corrected as shown below:

Column 1, line 11, delete the entire line and insert --II. Description of the Prior Art--;

Column 2, line 13, following "several" delete "view" and insert --views--;

Column 2, line 45, following "portion" insert --38--;

Column 2, line 56, following "center" delete "56" and following "heel" insert --56--;

Column 3, line 23, following "extremity" insert --126--;

Column 3, line 24, following "member" delete --126-- and insert --116--;

UNITED STATES PATENT AND TRADEMARK OFFICE

CERTIFICATE OF CORRECTION

PATENT NO. : 4,253,270

DATED : March 3, 1981

INVENTOR(S) : Carl E. Elwing and Mary J. Elwing

It is certified that error appears in the above-identified patent and that said Letters Patent are hereby corrected as shown below:

Column 4, line 14, following "member" insert --and--;

Column 4, lines 24 and 25, following "member" delete "to the sides of a front cross member";

Column 4, line 30, following "claim" delete "3" and insert --1--.

Signed and Sealed this

*Sixteenth* Day of *June 1981*

[SEAL]

*Attest:*

RENE D. TEGTMEYER

*Attesting Officer* *Acting Commissioner of Patents and Trademarks*